US007392757B2

(12) United States Patent
Niebur

(10) Patent No.: US 7,392,757 B2
(45) **Date of Patent: *Jul. 1, 2008**

(54) FAIRLEAD WITH INTEGRATED CHAIN STOPPER

(75) Inventor: Alvin J. Niebur, Hastings, MN (US)

(73) Assignee: Hydralift AmClyde, Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/509,371

(22) Filed: Aug. 24, 2006

(65) Prior Publication Data

US 2006/0283368 A1 Dec. 21, 2006

Related U.S. Application Data

(62) Division of application No. 10/945,553, filed on Sep. 20, 2004, now Pat. No. 7,104,214.

(60) Provisional application No. 60/508,615, filed on Oct. 3, 2003.

(51) Int. Cl.
*B63B 21/18* (2006.01)
*B63B 21/00* (2006.01)

(52) U.S. Cl. ..... 114/200; 114/230.2

(58) Field of Classification Search ..... None
See application file for complete search history.

(56) References Cited

U.S. PATENT DOCUMENTS

| | | | | |
|---|---|---|---|---|
| 4,186,464 | A | 2/1980 | Sandoy | |
| 4,862,821 | A | 9/1989 | Ballantyne | |
| 5,441,008 | A | 8/1995 | Lange | |
| 5,845,893 | A * | 12/1998 | Groves | 254/389 |
| 6,431,101 | B1 | 8/2002 | Lunde et al. | |
| 6,435,121 | B2 | 8/2002 | Siring | |
| 6,983,714 | B2 * | 1/2006 | Dove et al. | 114/293 |
| 7,104,214 | B2 * | 9/2006 | Niebur | 114/230.2 |

FOREIGN PATENT DOCUMENTS

SU 564208 A * 10/1977

* cited by examiner

*Primary Examiner*—Jesús D Sotelo
(74) *Attorney, Agent, or Firm*—Stuart R. Hemphill; Dorsey & Whitney LLP

(57) ABSTRACT

The present invention is a fairlead for guiding and securing an anchor chain between an offshore structure and an anchor. The fairlead comprises a fairlead frame, a pivoting latch, and an actuator. The fairlead frame is pivotally mounted to the offshore structure and supports an axle for a chain sheave. The pivoting latch is mounted to pivot on the axle and comprises a tension link with a chain latch and a counterweight for urging the chain latch into engagement with the chain. The pivoting latch is configured to engage the chain only when the chain is traveling in the payout direction. The actuator controls the action of the counterweight.

18 Claims, 14 Drawing Sheets

FAIRLEAD WITH INTEGRATED CHAIN STOPPER

CROSS REFERENCE TO RELATED APPLICATIONS

This present application is a divisional of and claims benefit under 35 U.S.C. § 119(e) to U.S. patent application Ser. No. 10/945,533, filed Sep. 20, 2004, now U.S. Pat. No. 7,104,214. This present application also claims benefit to U.S. Provisional Patent Application No. 60/508,615, filed Oct. 3, 2003, the contents of which are hereby incorporated in its entirety into the present application.

FIELD OF THE INVENTION

The present invention relates to apparatus and methods for handling a submerged swiveling mooring line used to moor a floating structure. More specifically, the present invention relates to a fairlead installed on an offshore platform or vessel, although it is not restricted to such uses.

BACKGROUND OF THE INVENTION

Offshore structures, such as floating production, drilling or construction platforms or other vessels, are moored in the desired location through the use of chains and/or cables extending between the platform and anchors on the ocean floor. Typically, the method for mooring floating platforms includes extending a chain in a catenary from the ocean anchor to a platform, through a fairlead device secured near the bottom of a platform column, to chain hauling equipment and a chain stopper on the deck of the platform. These elements are used to apply the desired mooring tension and to withstand the higher tensions that may be encountered in weather situations.

Mooring platforms in place at a drilling or production location usually require the presence of multiple chains, fairlead devices, anchors and chain equipment because of the massive size of the platforms. These all compete for space on the limited deck area of a platform, which also usually must be large enough for one or more buildings for housing workers and machinery, one or more cranes, and a drilling tower or production facilities.

Floatation of offshore platforms is often provided by large submerged pontoons. Large diameter columns extend upward from the pontoons to support the deck, and the mooring lines are led out from multiple columns. Thus, fairlead devices are usually secured to the columns of the platform below the waterline. For other vessels that are moored in place, the fairlead may be secured to a hull surface or structure extending from the main surface of the hull, also usually, but not exclusively, below the waterline. The mooring lines, often chains or combinations of wire rope and chain, pass from the anchors, through each of the fairlead devices, to line hauling equipment situated on the deck above.

In a typical installation, the anchor lines are installed by passing a messenger line (i.e., installation wire rope) from the deck, down through the submerged fairlead, mounted on a support column, and out to a pre-installed anchor line secured to the ocean floor. An end connector secures the messenger line to the anchor chain and the anchor chain is hauled back to the platform. The anchor chain passes through the fairlead and continues up to the deck as the chain is hauled in to achieve the desired mooring tension. Thus, one of the requirements of an underwater fairlead is that it be able to pass the chain itself, special connecting links and the messenger line.

Because the chain comes into the fairlead at an angle before ascending essentially vertically to the deck, a sheave is used to change direction. The sheaves used in these chain-mooring applications are usually pocketed wheels, known as wildcats, which receive links of the chain in pockets. This helps reduce the chain stresses in the links resting on the wildcat.

On the deck, the chain hauling equipment pre-tensions the chain up to a predetermined percentage of the chain-breaking load. To relieve the chain hauling equipment of the tension load, a chain stopper or chain latch locks the chain in place at the pre-tension load. In some prior art fairleads, the chain stopper or chain latch is made a part of or connected to the fairlead. In that case, the chain stopper or latch will remain submerged in normal use and during servicing. Thus, it is desirable to have a mechanism that needs little service and is easy to service when required.

There is a need in the art for a fairlead design that is simpler and more reliable than existing designs.

BRIEF SUMMARY OF THE INVENTION

The present invention, in one embodiment, is a fairlead apparatus for guiding and securing a chain used for mooring an offshore structure. The fairlead apparatus comprises a fairlead frame, a chain sheave, a chain latch, and a biasing mechanism for biasing said chain latch against the chain. The fairlead is pivotally mounted to the offshore structure. The chain sheave is mounted for rotation on a sheave axle supported by the fairlead frame. The chain latch assembly is mounted for pivotal movement on the sheave axle and comprises a tension link with a chain latch adapted to engage the chain. In one embodiment, the chain latch engages the chain when the chain latch is biased against the chain and the chain is traveling in the payout direction.

The present invention, in one embodiment, is a fairlead for guiding and securing an anchor chain between an offshore structure and an anchor. The fairlead comprises a fairlead frame, a pivoting latch, and an actuator. The fairlead frame is pivotally mounted to the offshore structure and supports an axle for a chain sheave. The pivoting latch is mounted to pivot on the axle and comprises a tension link with a chain latch and a counterweight for urging the chain latch into engagement with the chain. In one embodiment, the pivoting latch is configured to engage the chain only when the chain is traveling in the payout direction. The actuator is for controlling action of the counterweight.

The present invention, in one embodiment, is a fairlead for guiding and securing an anchor chain between an offshore structure and an anchor. The fairlead comprises a fairlead frame, a pivoting latch, and an actuator. The fairlead frame is pivotally mounted to the offshore structure and supports an axle for rotatably supporting a chain sheave. The pivoting latch is mounted and supported on the fairlead frame to pivot in a plane perpendicular to the axle supporting the chain sheave. The pivoting latch comprises a tension link with a chain latch and a counterweight for urging the chain latch into engagement with the chain. The actuator is for controlling action of the counterweight.

The present invention, in another embodiment, is a method for guiding and securing an anchor chain between an offshore structure and an anchor. The method comprises providing a chain sheave rotatably mounted on an axle supported by a fairlead frame, in-hauling the anchor chain with the chain sheave so the anchor chain's line of action is essentially tangential to the circumference of the chain sheave, and changing the anchor chain's line of action to be essentially in-line with the axis of the axle.

The present invention, in another embodiment, is a fairlead for guiding and securing a chain used for mooring an offshore structure. The fairlead comprises a fairlead frame, a first structure and a second structure. The fairlead frame is pivotally mounted to the offshore structure. The first structure is coupled to the fairlead frame and adapted to cause a line of action of the chain, when the chain is being paid out or in-hauled, to bend about, and be generally tangential with, a radius having a center point. The second structure is adapted to change the line of action to one that is generally inline with the center point.

In one embodiment, the fairlead further comprises an apparatus adapted to bias a portion of the second structure against the chain. In one embodiment, the portion of the second structure is adapted to catch the chain when the chain is being paid out, but to ratchet along the chain without catching the chain when the chain is being in hauled. In one embodiment, the second structure is pivotable about the center point.

The present invention, in another embodiment, is a fairlead for guiding and securing a chain used for mooring an offshore structure, the fairlead comprises a fairlead frame, a first structure and a second structure. The fairlead frame is pivotally mounted to the offshore structure. The first structure is coupled to the fairlead frame and adapted to cause a line of action of the chain, when the chain is being paid out or in-hauled, to bend about, and be generally tangential with, a radius having a center point. The second structure pivotally depends from the fairlead frame, is adapted to engage the chain, and has a sensor for reading a tension force in the chain.

In one embodiment, the first structure is a wildcat mounted for rotation on an axle supported by the fairlead frame, the axle being centered on the center point. In one embodiment, the second structure is pivotally mounted on the axle. In one embodiment, the second structure is adapted to change the line of action to one that is generally inline with the center point.

In one embodiment, the sensor is a strain gage equipped bolt having a longitudinal axis that is generally parallel to a longitudinal axis of the second structure. In one embodiment, the sensor is a strain gage equipped load pin having a longitudinal axis that is generally perpendicular to a longitudinal axis of the second structure.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

Figure 1A:
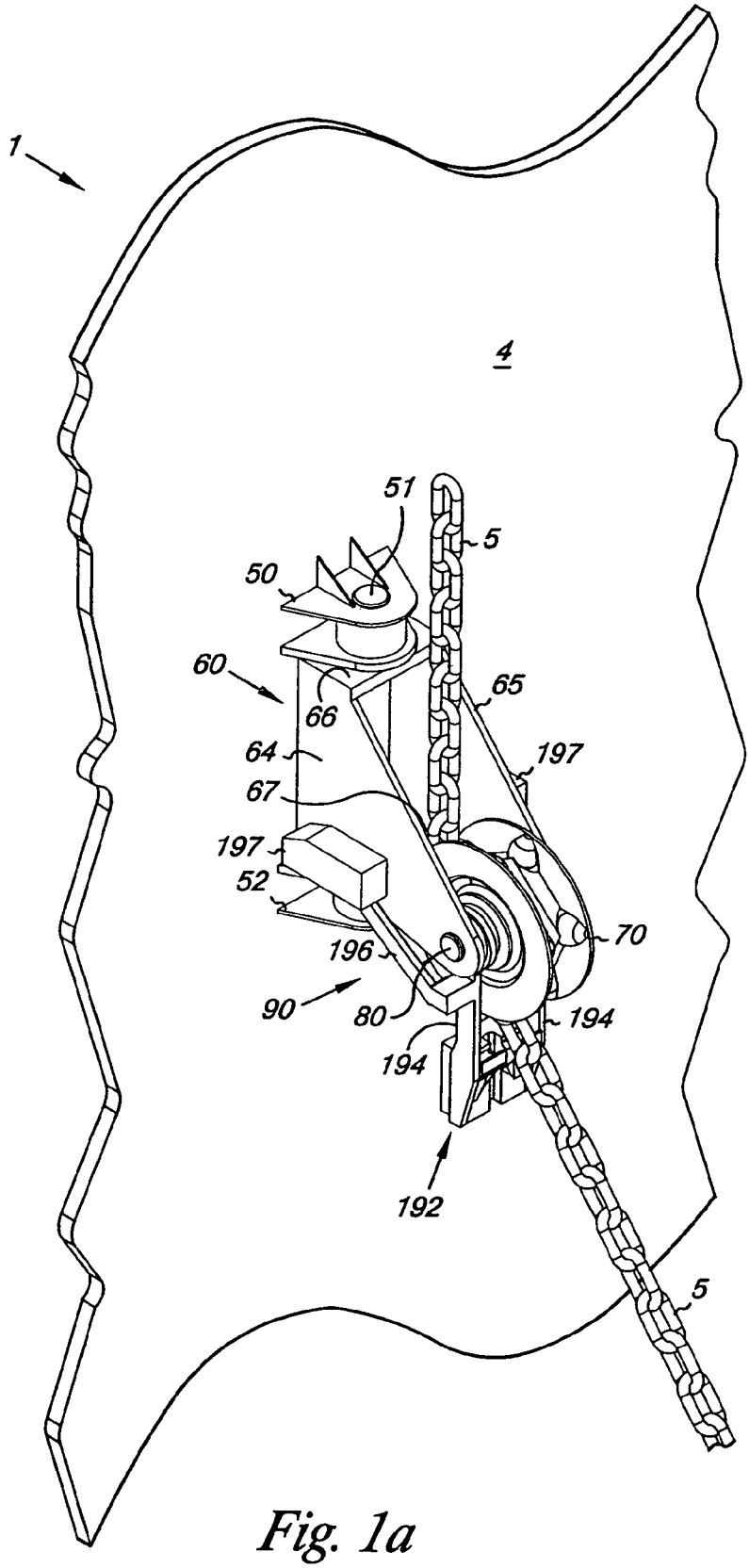
FIG. 1*a* is a perspective view of a fairlead of the present invention.
Figure 1B:
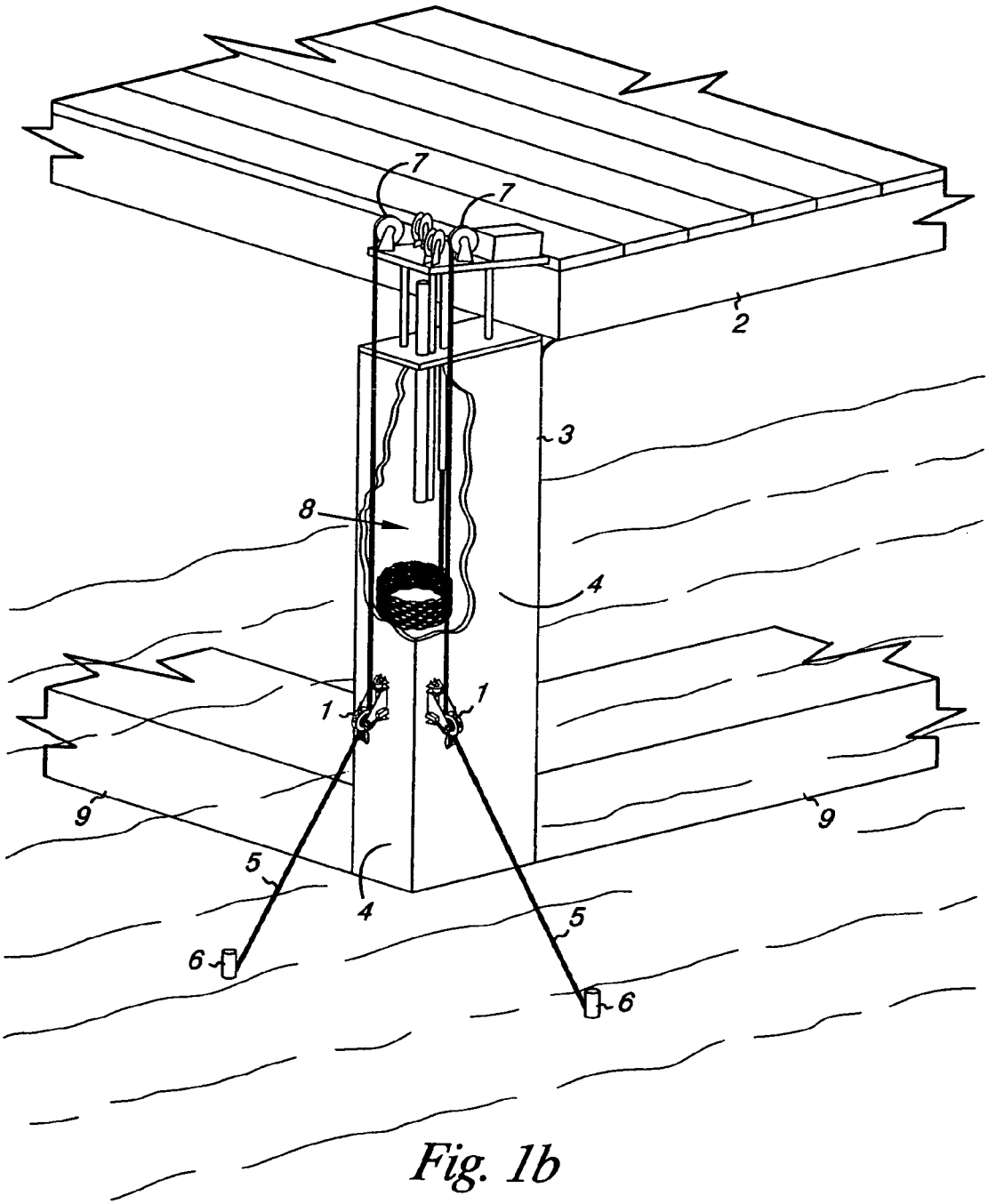
FIG. 1*b* is a perspective view of a portion of an offshore platform (e.g., a floating dock, barge, vessel, or ship), wherein the fairlead of FIG. 1*a* is employed at two underwater locations on a column of the offshore platform.

FIG. 1*a* is a perspective view of the fairlead 1 of the present invention. FIG. 1*b* is a perspective view of a portion of an offshore platform 2 (e.g., a floating dock, barge, vessel, or ship), wherein fairleads 1 are employed at two underwater locations on a column 3 of the offshore platform 2. Although an offshore platform 2 is a common application, the fairlead 1 may be employed on other types of vessels (e.g., ship-shaped vessels).

As illustrated in FIG. 1*b*, the fairleads 1 are mounted on a hull structure 4 that is part of a column 3 used to support a corner of the offshore platform 2. An anchor line 5 (e.g., a chain or cable) extends up from an underwater anchor 6, through the fairlead 1, and up out of the water to the hauling equipment 7. The chain 5 may then extend back down inside the hull structure 4 to chain locker 8 or other storage arrangement for excess chain.

As shown in FIG. 1*a*, the fairlead 1 comprises a fairlead frame 60, a chain sheave 70, and a chain latch assembly 90. The chain sheave 70 is used for initial installation and pre-tensioning of the mooring chain 5. The chain latch assembly 90 is used to transfer the chain tension from the chain sheave 70 to the fairlead frame 60 and into the hull structure 4, once the chain pre-tensioning is complete.

As illustrated in FIG. 1*a* and FIGS. 2*a*-2*c*, the fairlead frame 60 has one end pivotably attached to the hull structure 4 and another end supporting a horizontal sheave axle 80. The fairlead frame 60 comprises two vertically oriented side frames plates 64, 65 joined by top and bottom horizontal plates 66, 67 extending perpendicularly between the side frame plates 64, 65. The top and bottom horizontal plates 66, 67 are pivotably attached to upper and lower foundation brackets 50, 52 via upper and lower vertical swivel pins 51, 53. Specifically, the upper swivel pin 51 is connected between the upper foundation bracket 50 and the top horizontal plate 66, and the lower swivel pin 53 is connected between the lower foundation bracket 52 and the bottom horizontal plate 67. The upper and lower foundation brackets 50, 52 are secured to the hull structure 4 of the offshore platform 2.

The chain sheave 70 is rotatable about the horizontal sheave axle 80 and is thereby supported by the fairlead frame 60. In one embodiment, the chain sheave 70 may be a pocketed "wildcat" or similar sheave around which the anchor chain 5 may be guided as the chain 5 transitions from its anchor-to-fairlead path to its vertical path extending up to the deck above.

The chain latch assembly 90 is pivotable about the horizontal sheave axle 80 and comprises a latch head 192, a pair of tension links 194, a pair of counterweight arms 196, and a pair of counterweights 197. The latch head 192 is adapted to engage the chain 5 and the counterweights 197 act to bias the latch head 192 against the chain 5.

When the chain 5 is hauled in or paid out to adjust the tension in the chain 5, the sheave 70 rotates about the horizontal sheave axle 80 as the chain 5 passes through the fairlead 1. When the chain latch assembly 90 is engaged, it prevents the chain 5 from displacing through the fairlead 1 and transfers the chain tension forces to the horizontal sheave axle 80, where the forces are transmitted to the fairlead frame 60, through the upper and lower foundation brackets 50, 52 (with swivel pins 51, 53) and into the hull structure 4 of the offshore platform 2.

Figure 2A:
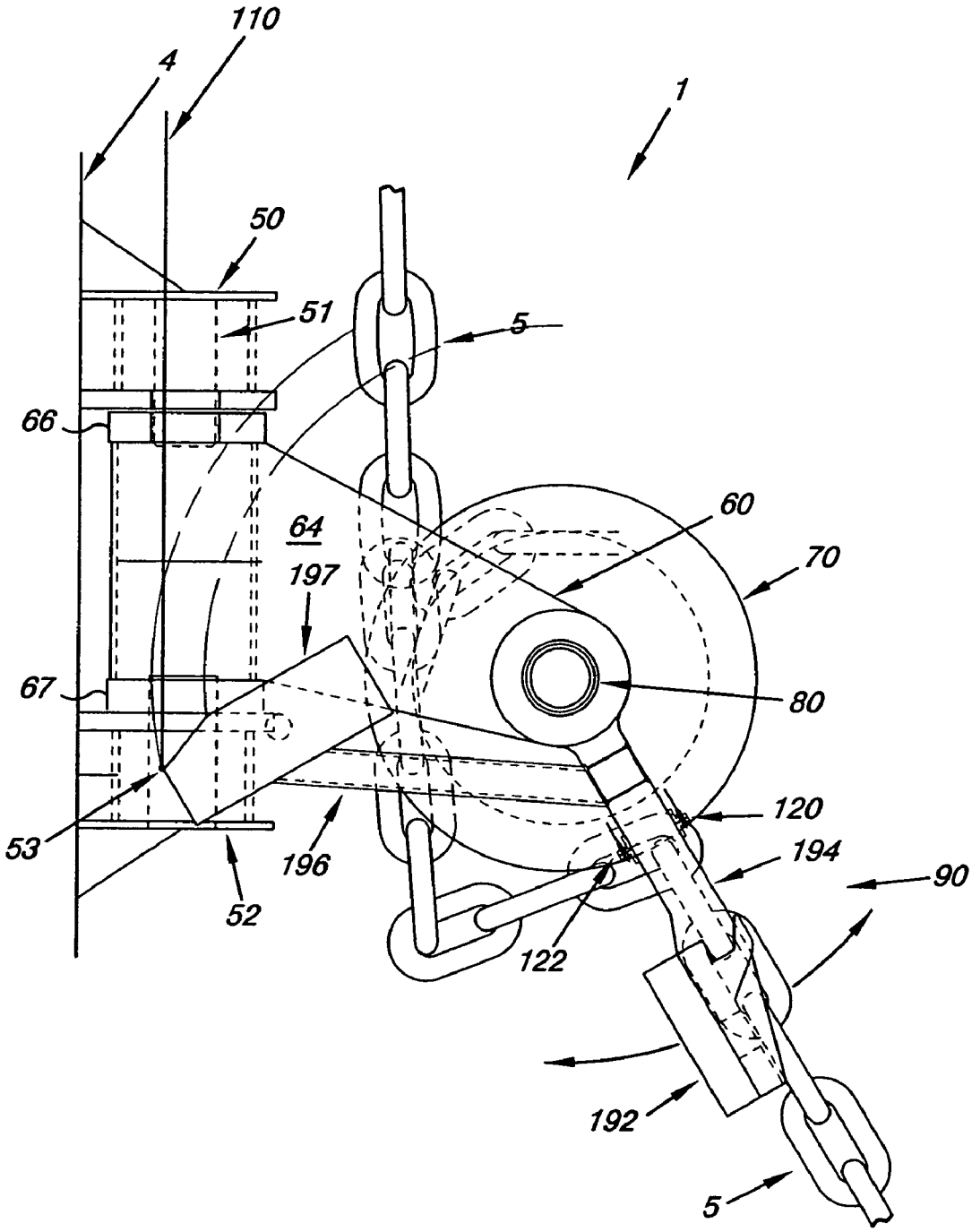
FIG. 2*a* is a side elevation of the fairlead of the present invention with the chain latch engaged.
Figure 2B:
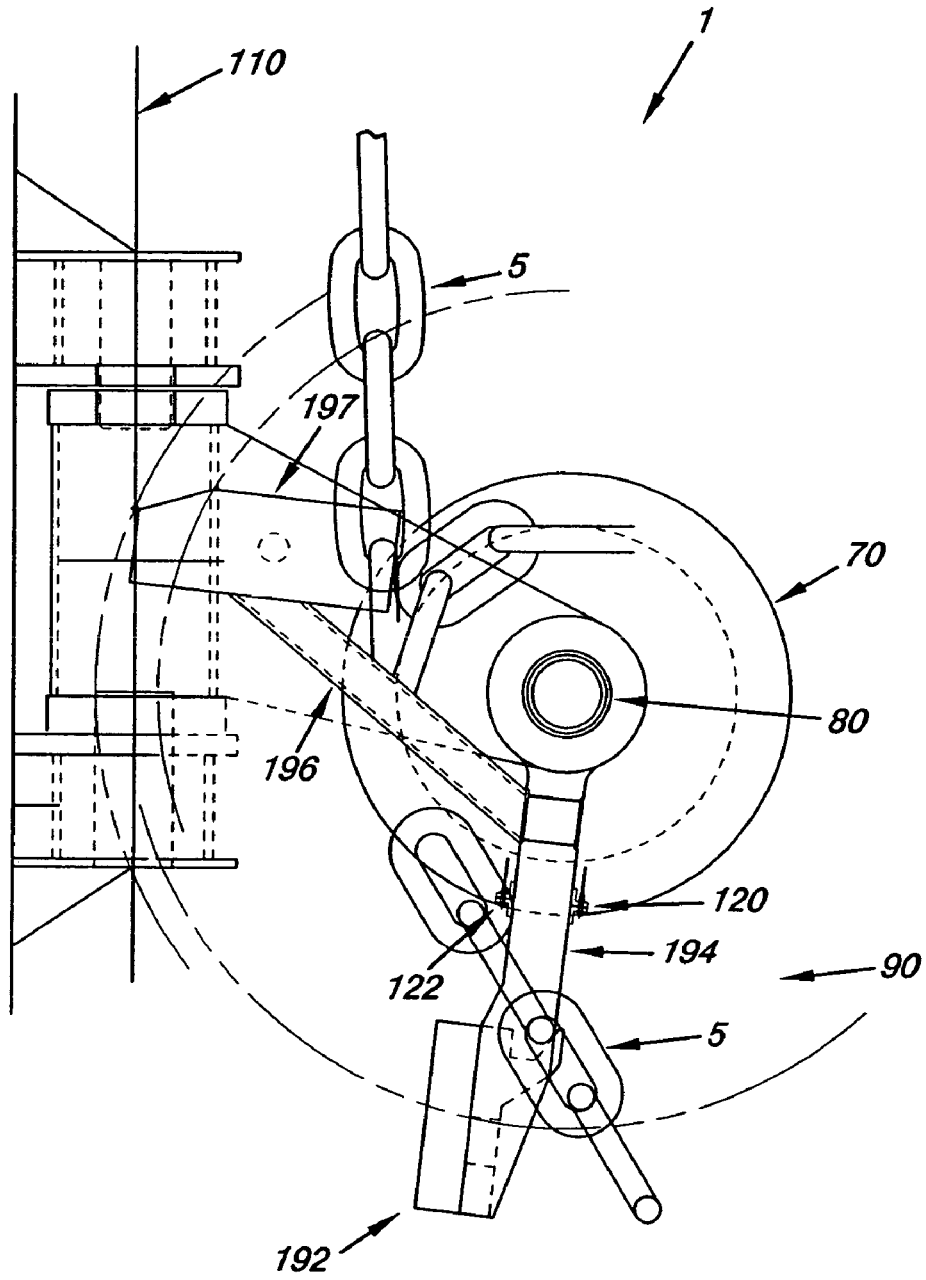
FIG. 2*b* is a side elevation of the fairlead of the present invention with the chain latch in position for ratcheting or riding on the chain during in hauling.
Figure 2C:
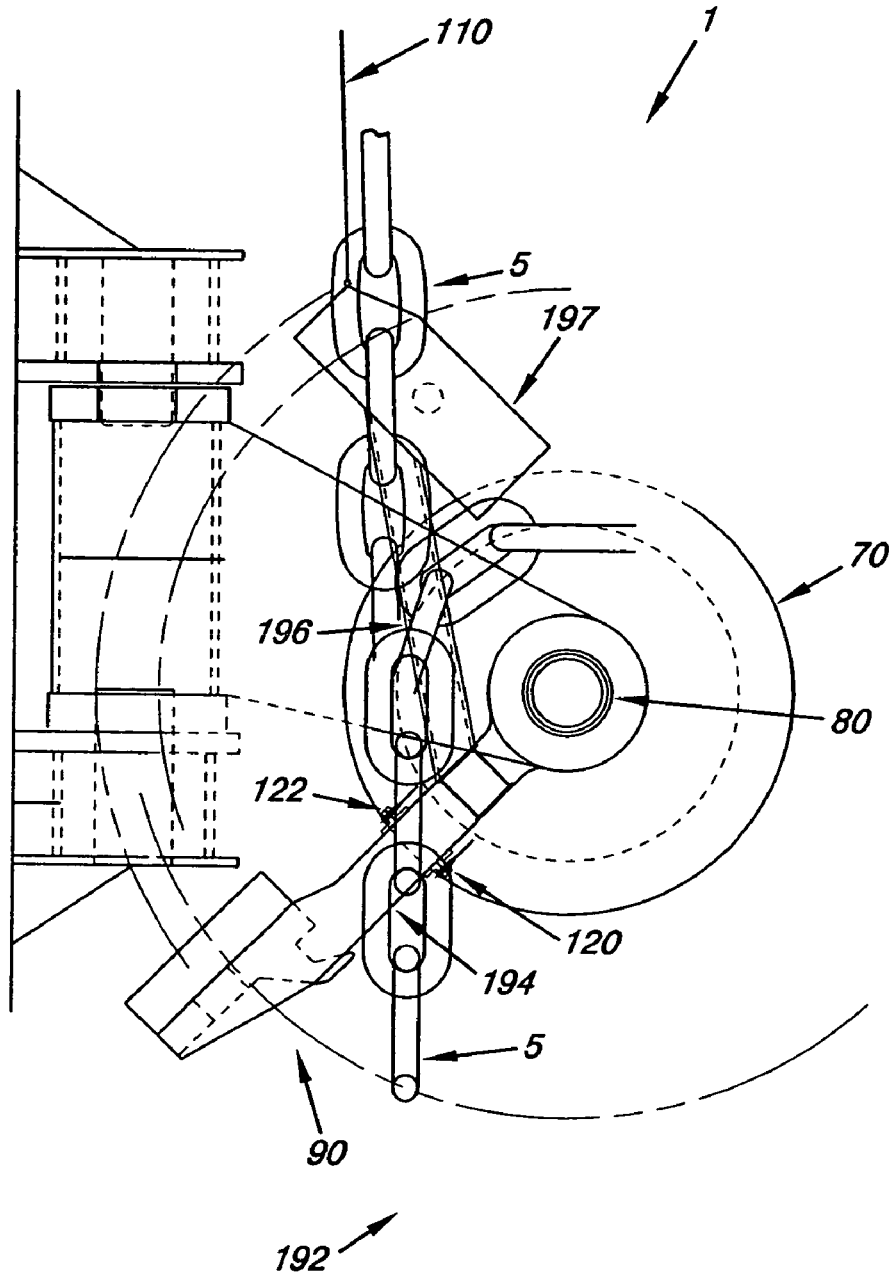
FIG. 2*c* is a side elevation of the fairlead of the present invention with the chain latch in position for releasing the chain.

FIGS. 2*a*-2*c* are side elevations of the fairlead 1 of the present invention with the chain latch assembly 90 in the various positions it can assume. Specifically, FIG. 2*a* is a side elevation of the fairlead 1 with the chain latch assembly 90 engaged to secure the chain 5; FIG. 2*b* is a side elevation of the fairlead 1 with the chain latch assembly 90 in position for ratcheting or riding on the chain 5 during in-hauling; FIG. 2*c* is a side elevation of the fairlead 1 with the chain latch assembly 90 in position for releasing the chain 4.

As illustrated in FIG. 2*a*, when the chain latch assembly 90 is in its latching or catching position, the latch head 192 engages a link in the chain 5 and secures the chain 5 against further payout. The counterweights 197 cause the chain latch assembly 90 to tend to pivot in a counterclockwise direction as seen in FIGS. 2*a*-2*c*. Thus, the chain latch assembly 90 is biased into contact with the chain 5 and, in particular, the latch head 192 is urged to ride on the chain 5 and to swing into a chain grasping position in which the latch head 192 grasps a link so the chain 5 cannot move further off the sheave 70 toward the anchor 6.

As shown in FIG. 2*b*, when the chain latch assembly 90 is in position for riding on the chain 5 during in hauling, the chain latch assembly 90 serves a ratcheting function. As long as in-hauling continues, the configuration of the latch head 192 causes the chain latch assembly 90 to ride on, but not latch or hitch into, the chain 5.

As indicated in FIG. 2*c*, when the chain latch assembly 90 is in position for releasing the chain 5, the latch head 192 completely clears the chain 5. Because the counterweights 197 bias the latch head 192 against the chain 5, the chain latch assembly 90 must be urged fully out of engagement with the chain 5. In one embodiment, this is achieved by in hauling on the chain 5 to transfer the tension from the tension links 194 to the sheave 70 and then pulling on a tag line 110 to lift the counterweights 197, thereby causing the chain latch assembly 90 to pivot clockwise, which causes the latch head 192 to completely clear the chain 5.

Figure 3:
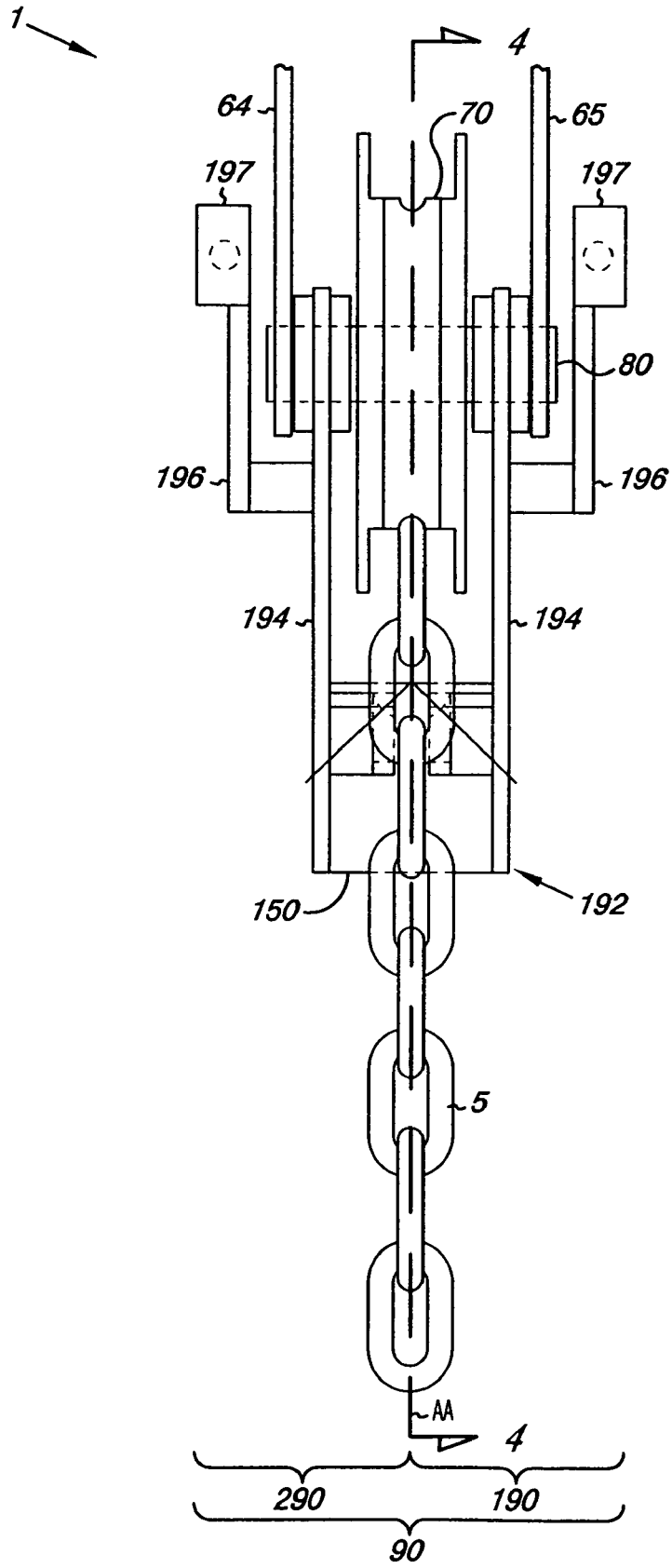
FIG. 3 is an end elevation of the fairlead of the present invention with the chain latch in position for ratcheting on the chain during in hauling.
Figure 4:
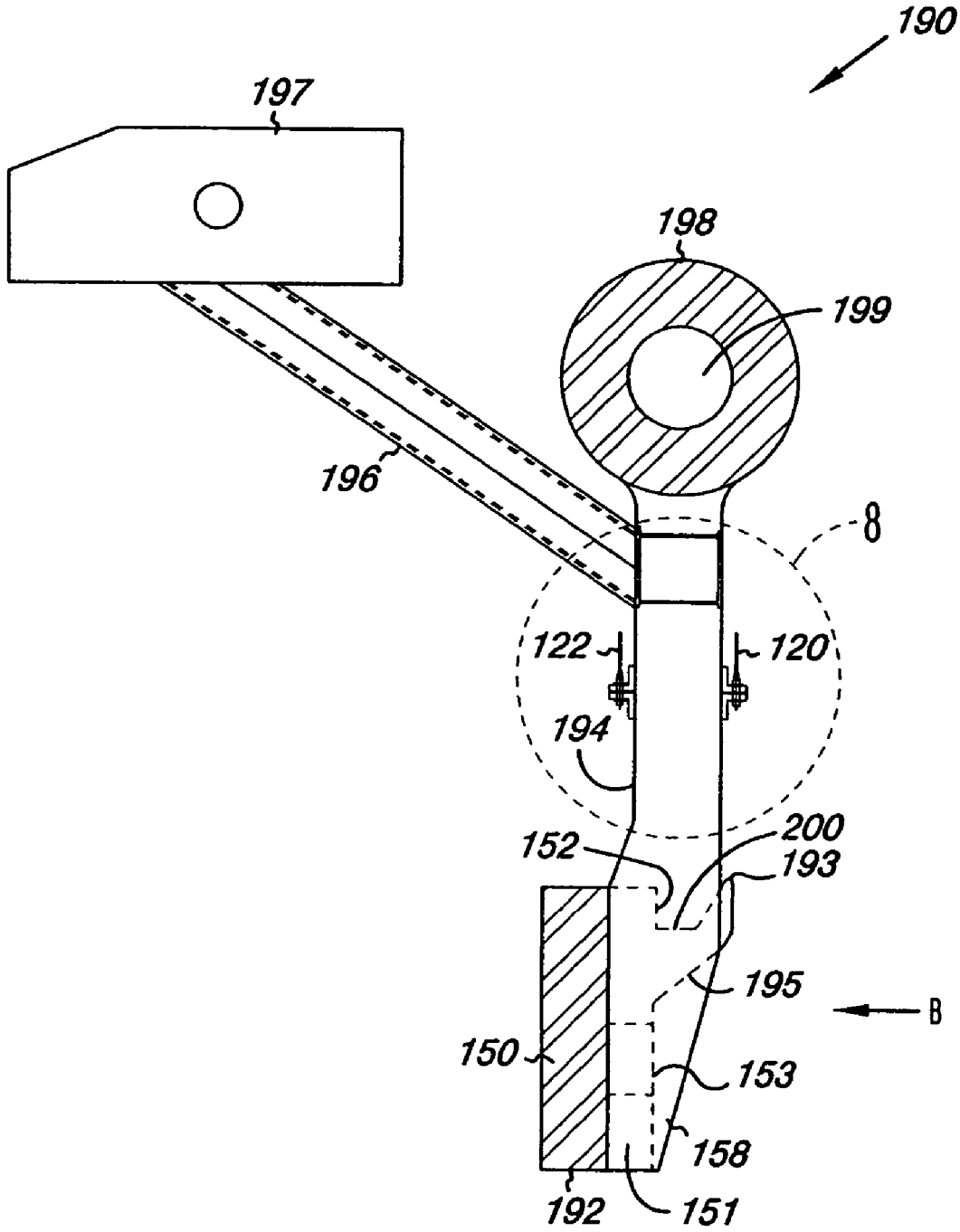
FIG. 4 is a side elevation of one half of the pivoting chain latch assembly of the fairlead of the present invention as it would appear if seen from section line AA of FIG. 3.

For a more detailed discussion of the chain latch assembly 90, reference is now made to FIGS. 3 and 4. FIG. 3 is an end elevation of the fairlead 1 with the chain latch assembly 90 in position for ratcheting on the chain 5 during in hauling. FIG. 4 is a side elevation of one half of the chain latch assembly 90 of the fairlead 1 as it would appear if seen from section line AA of FIG. 3.

As shown in FIG. 3, the chain latch assembly 90 is generally symmetrical around a plane that is perpendicular to the horizontal sheave axle 80 and bisects the sheave 70. Bisecting the chain latch assembly 90 by said plane results in two symmetrical half sections, the right half section 190 and the left half section 290 of FIG. 3.

As indicated in FIG. 4, which is a side elevation of the right symmetrical half 190 of the chain latch assembly 90 illustrated in FIG. 3, one end of the tension link 194 is attached to the latch head 192, and the other end is attached to an axle hub 198 having an axle opening 199 that is adapted to receive, and pivot about, the horizontal sheave axle 80 of the fairlead frame 60. One end of the counterweight support arm 196 attaches to the tension link 194 between the tension link's ends, and the other end of the counterweight support arm 196 is attached to the counterweight 197.

As shown in FIG. 4, in one embodiment, the latch head 192 comprises an engaging hook, latch or catch 193, a link slot wall 151, a short link platform 152, a long link platform 153, a connection plate 150, and head sidewalls 158. The engaging hook, latch or catch 193 forms a link receiving pocket 200 and has a sloped backside 195 that allows a link to slide up and over the latch 193 as the chain 5 is in-hauled. This assembly may be cast, forged or milled as a single unit.

As previously stated, the left half 290 of the chain latch assembly 90 is a mirror image of the right half 190 shown in FIG. 4. The two halves 190 and 290 join at the connection plate 150 and the axle hub 198 to form one integral unit, as indicated in FIG. 3. The connection plate 150 extends between the engaging hook, latch or catch 193 of the right half 190 and its symmetrical counterpart in half 290.

Figure 5A:
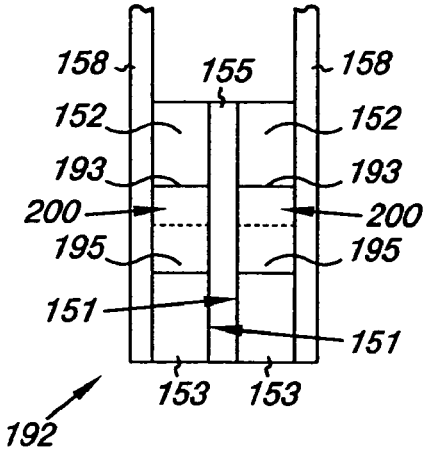
FIG. 5*a* is an end elevation of the latch head without the chain being present and as the latch head would appear if viewed from the direction indicated by arrow B in FIG. 4.
Figure 5B:
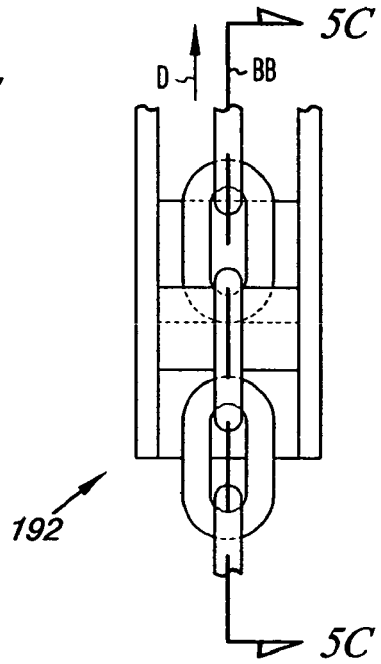
FIG. 5*b* is the same view of the latch head illustrated in FIG. 5*a*, except with the chain being present.
Figure 5C:
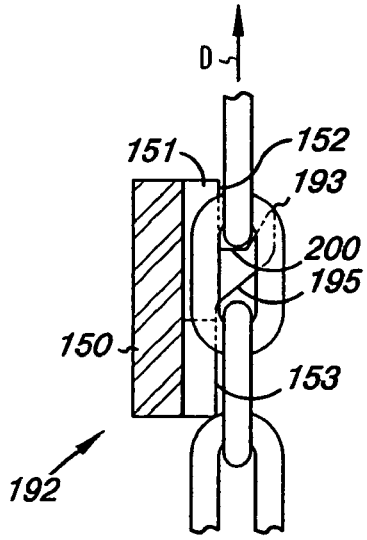
FIG. 5*c* is a sectional elevation of the latch head with the chain as the latch head would appear if seen from section line BB in FIG. 5*b*.

For a more detailed discussion of the latch head 192, reference is now made to FIGS. 5*a*-5*c*. FIG. 5*a* is an end elevation of the latch head 192 without the chain 5 being present and as the latch head 192 would appear if viewed from the direction indicated by arrow B in FIG. 4. FIG. 5*b* is the same view of the latch head 192 illustrated in FIG. 5*a*, except with the chain 5 being present. FIG. 5*c* is a sectional elevation of the latch head 192 with the chain 5 as the latch head 192 would appear if seen from section line BB in FIG. 5*b*.

As illustrated in FIG. 5*a*, the link slot walls 151 form a link receiving slot 155 that runs the full length of the latch head 192. As indicated in FIGS. 5*b* and 5*c*, the link-receiving slot 155 is adapted to accommodate links that are oriented perpendicularly to the link platforms 152, 153 as the chain 5 is in-hauled in the direction indicated by arrow D. As shown in FIGS. 5*b* and 5*c*, the links that are oriented parallel to the link platforms 152, 153 slide along the link platforms 152, 153 and the sloped backsides 195 of the engaging latches 193 as the chain 5 is in-hauled in the direction indicated by arrow D. As illustrated in FIGS. 5*b* and 5*c*, when the chain 5 has been paid out opposite the direction indicated by arrow D, and the chain 5 has been latched onto by the latch head 192, one end of a link that is parallel to the link platforms 152, 153 resides within the link receiving pockets 200 formed by the latches 193 as links that are perpendicular to the link platforms 152, 153 are accommodated by the link receiving slot 155.

Figure 6A:
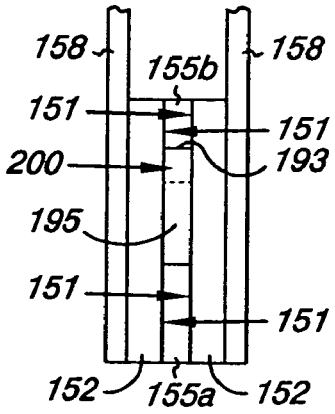
FIG. 6*a* is the same view of the latch head illustrated in FIG. 5*a*, except the latch head has an alternative configuration.
Figure 6B:
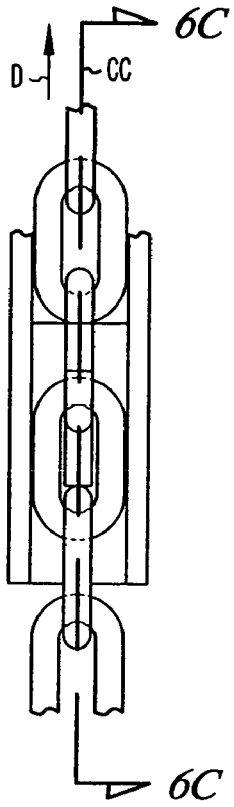
FIG. 6*b* is the same view of the latch head illustrated in FIG. 6*a*, except with the chain being present.
Figure 6C:
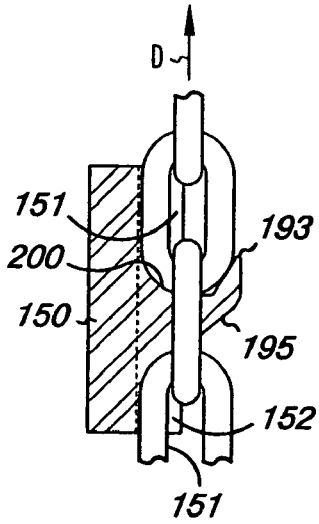
FIG. 6*c* is a sectional elevation of the latch head with the chain as the latch head would appear if seen from section line CC in FIG. 6*b*.

FIGS. 4-5*c* illustrate a latch head 192 with latches 193 that contact the exterior edge of a link residing in the link receiving pockets 200 without the latches 193 passing through the interior space of an immediately adjacent link. However, the latch head 192 may employ other configurations and still be considered within the scope of the present invention. For example, FIGS. 6*a*-6*c*, which are respectively the same views as FIGS. 5*a*-5*c*, illustrate a latch head 192 with an alternative configuration. As shown in FIGS. 6*a*-6*c*, the latch head 192 comprises short and long link receiving slots 155*a*, 155*b*, head sidewalls 158, link platforms 152, and a single latch 193 that is in-line with the link receiving slots 155*a*, 155*b*. The latch 193 forms a link-receiving pocket 200 and has a sloped backside 195.

With the exception of the single latch 193 and its link-receiving pocket 200, the corresponding features of the latch head 192 illustrated in FIGS. 6*a*-6*c* function similarly to those illustrated in FIGS. 5*a*-5*c*. The single latch 193, of the latch head 192 shown in FIGS. 6*a*-6*c*, contacts the exterior edge of a link by passing through the interior space of an immediately adjacent link.

As can be understood from FIGS. 2*a*-6*c* and the preceding disclosure, the latch head 192 is configured so it engages the chain 5 only when the latch head 192 is biased against the chain 5 and the chain 5 is traveling in a payout direction that is opposite to the direction indicated by arrow D in FIGS. 5*b*, 5*c*, 6*b* and 6*c*. Although the latch head 192 may be biased against the chain 5, the latch head 192 is configured so it ratchets or rides on the chain 5, without engaging the chain 5, when the chain 5 is traveling in an in-haul direction as indicated by arrow D in FIGS. 5*b*, 5*c*, 6*b* and 6*c*.

Figure 7A:
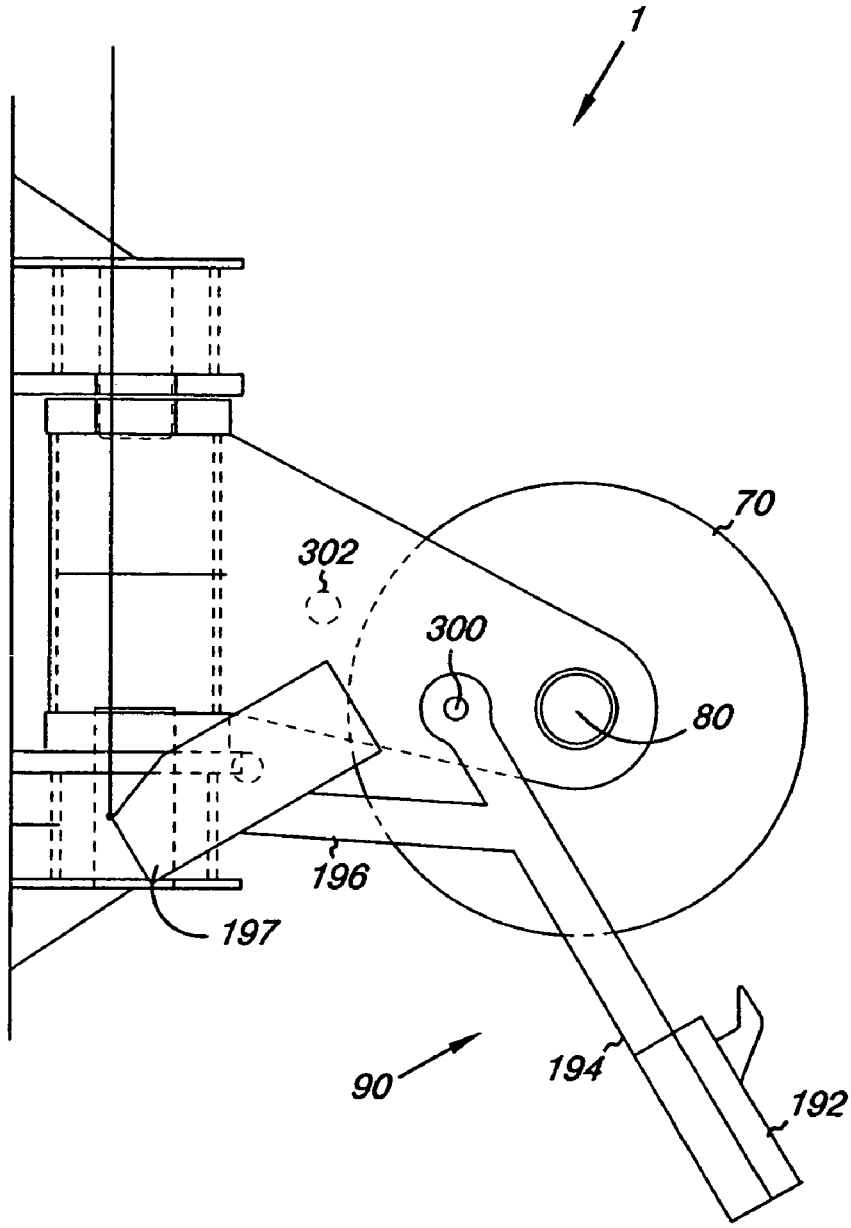
FIG. 7*a* is a side elevation of the fairlead of the present invention having an alternative pivot point for the chain latch assembly.
Figure 7B:
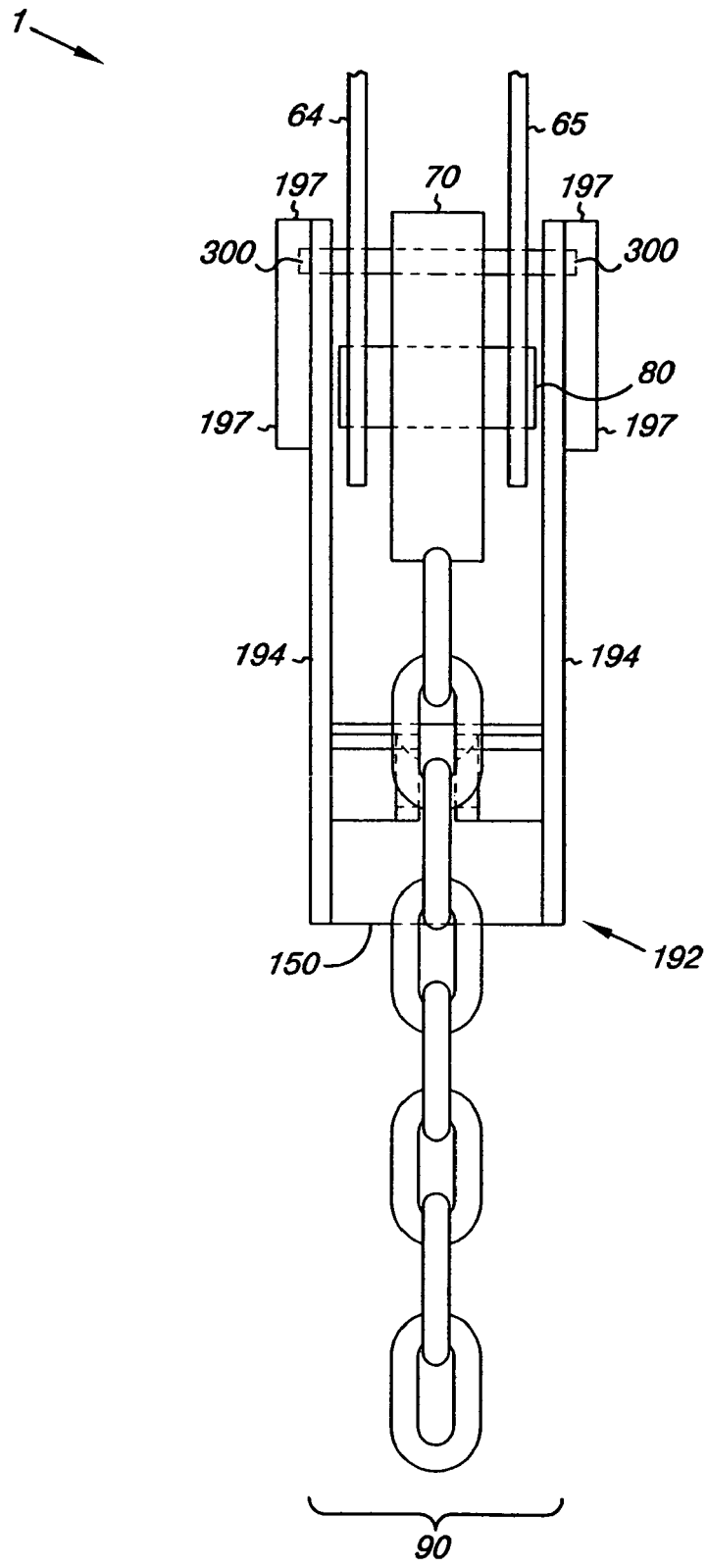
FIG. 7*b* is an end elevation of the fairlead illustrated in FIG. 7*a*.

In one embodiment, the chain latch assembly 90 is preferably mounted for pivotal motion on the sheave axle 80. However, as illustrated in FIGS. 7*a* and 7*b*, which are side and end elevation views, respectively, of another embodiment of the fairlead 1, the chain latch assembly 90 is mounted for similar pivotal motion on pivot pins 300 supported by the fairlead frame 60. The chain latch assembly 90 could also be supported at a second axle 302 (as shown in phantom in FIG. 7*a*) so as not to interfere with the sheave 70.

LOAD SENSORS

Monitoring of loads in mooring lines 5 is desirable for a number of reasons. The fairlead 1 of the present invention provides a convenient platform for this monitoring. As illustrated in FIGS. 2*a*-2*c* and FIG. 4, a pair of load sensors 120, 122 is mounted on opposite sides of each tension link 194 of the chain latch assembly 90. These load sensors 120, 122 are more clearly represented in FIG. 8, which is a detail view of the load sensors 120, 122 shown in FIG. 4.

Figure 8:
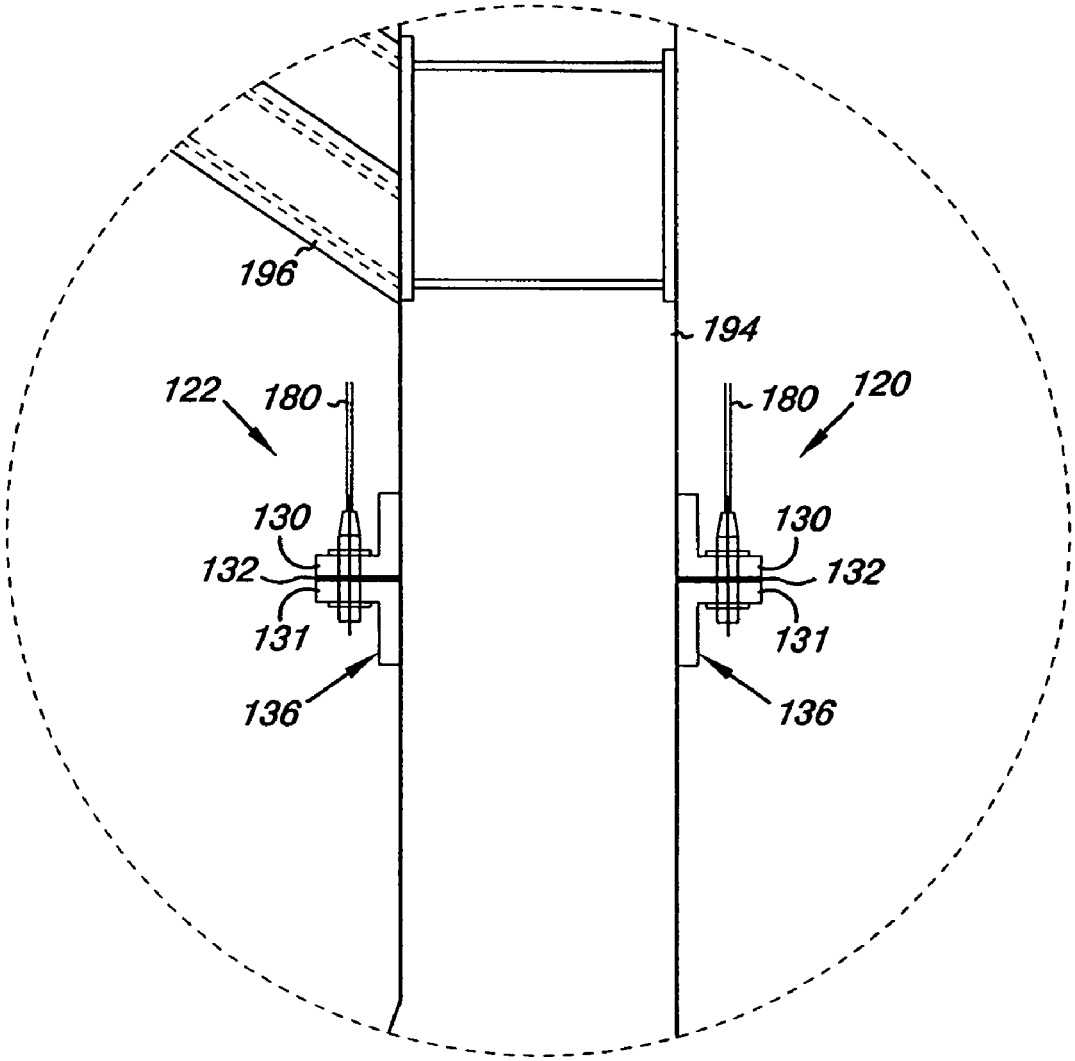
FIG. 8 is a detail view of the load sensors that are mounted on the tension links of the fairlead of the present invention as indicated in FIG. 4.

As indicated in FIG. 8, each load sensor 120, 122 comprises a pair of upper and lower brackets 130, 131 with a gap 132 placed between them. A force sensing bolt or stud 136 is threaded between the brackets 130. An electrical link 180 supplies any necessary power to the force sensing bolt or stud 136 and carries any signal produced by the bolt or stud 136 off to a monitoring unit (not shown). A suitable bolt or stud 136 for the tension links 194 is a force sensing bolt 136 available from Strainsert Company (among others) located at www.strainsert.com and 12 Union Hill Road, West Conshohocken, Pa. 19428. Because each tension link 194 is equipped with force sensing bolts 136, one or more bolts 136 could be replaced by a remote operated vehicle ("ROV") in the event of bolt sensor failure without removing the chain.

Figure 9B:
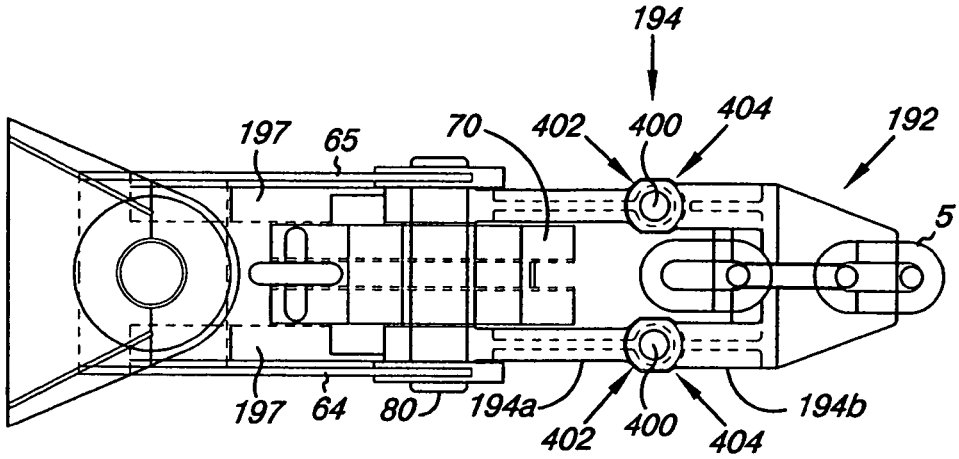
FIG. 9*b* is a plan view of the fairlead depicted in FIG. 9*a*.
Figure 9A:
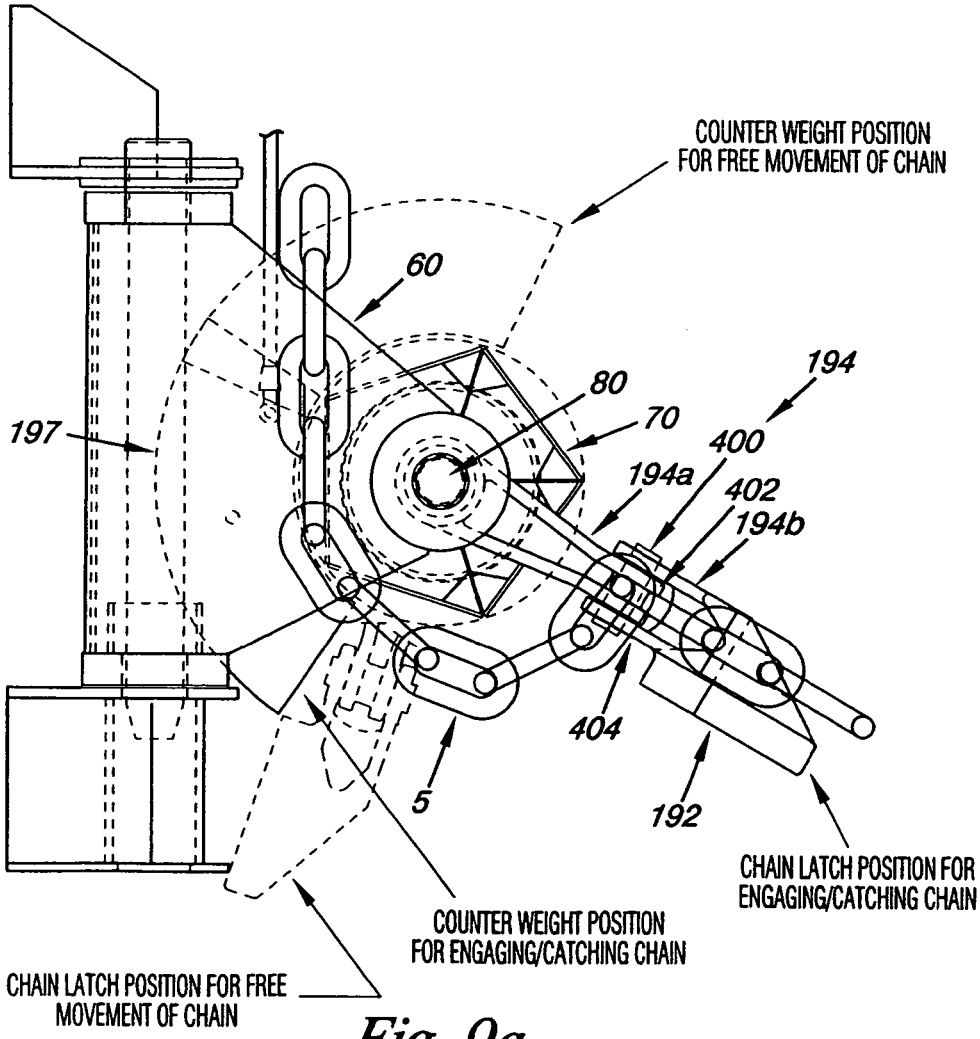
FIG. 9*a* is a side elevation of the fairlead depicting a sensor and tension link arrangement of an alternative embodiment of the invention.

In an alternative embodiment, as depicted in FIGS. 9*a* and 9*b*, which are, respectively, side elevation and plan views of the fairlead 1 of the present invention, each tension link 194 has an upper segment 194*a* and a lower segment 194*b* joined together via a load pin 400. As indicated in FIGS. 9*a* and 9*b*, in one embodiment, each upper segment 194*a* extends from the horizontal sheave axle 80 to a male end 402 having a hole that is transverse to the longitudinal length of the upper segment 194*a* and adapted to receive the load pin 400. Each lower segment 194*b* extends from the latch head 192 to a female end 404 adapted to receive the corresponding male end 402 and having a hole that is transverse to the longitudinal length of the lower segment 192*b* and adapted to receive the load pin 400.

Like the bolts 136 depicted in FIGS. 4 and 8, the load pins 400 are strain gage equipped and serve as a mechanism for monitoring tension in the tension links 194. Unlike the bolts 136, which measure tension forces, the load pins 400 measure shear stresses that are then utilized to calculate the tension in the chain 5.

ALTERNATIVE CONFIGURATIONS

As indicated in FIGS. 1-4, in one embodiment, the fairlead 1 is configured such that its counterweights 197 displace along the exterior sides of the side frame plates 64, 65 of the fairlead frame 60. In one embodiment, as shown in FIGS. 9*a* and 9*b*, the fairlead 1 is configured such that its counterweights 197 displace between the interior sides of the side frame plates 64, 65 of the fairlead frame 60.

Figure 10B:
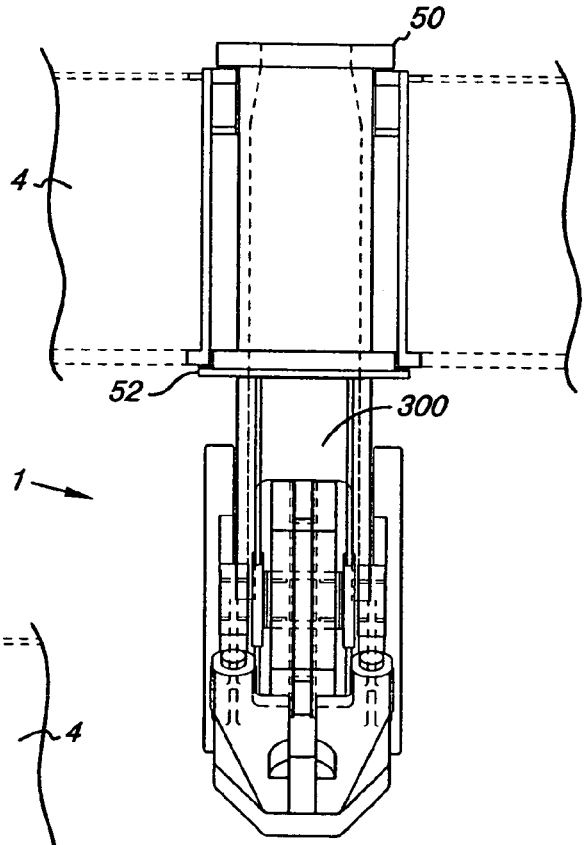
FIG. 10*b* is a front elevation view of the fairlead depicted in FIG. 10*a*.
Figure 10A:
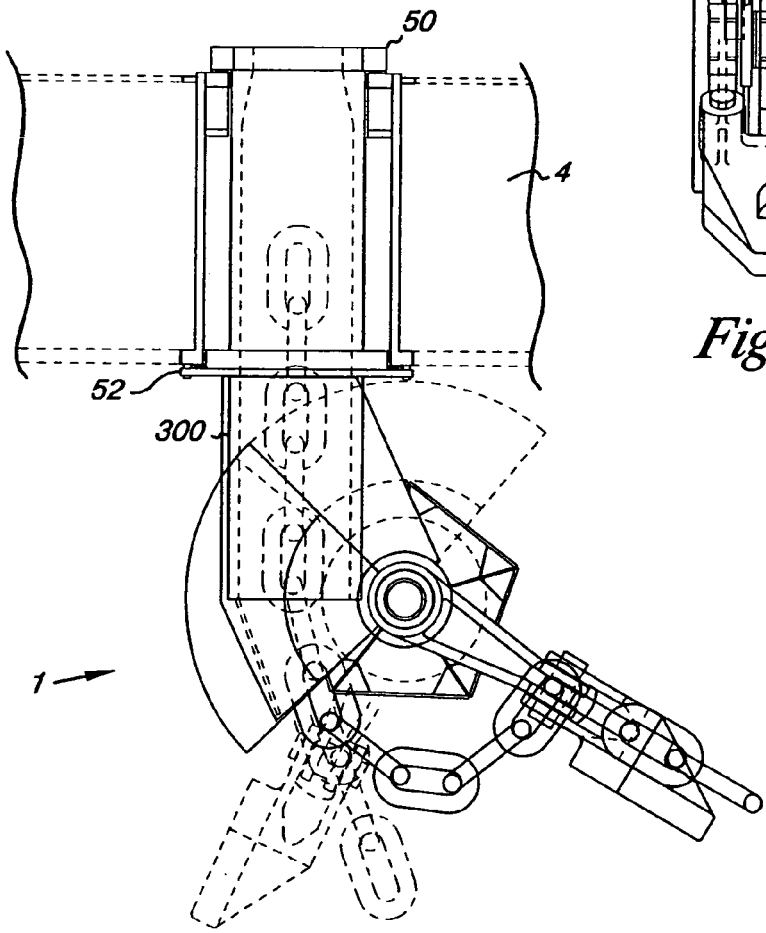
FIG. 10*a* is a side elevation view of a trunnion mounted fairlead.

As indicated in FIGS. 1-4, in one embodiment, the fairlead 1 is configured such that its frame 60 is pivotally coupled between an upper foundation bracket 50 and a lower foundation bracket 52. In another embodiment, the fairlead 1 is a trunnion mounted fairlead 1 as shown in FIGS. 10*a* and 10*b*, which are, respectively, a side elevation view and a front elevation view of the fairlead 1. As illustrated in FIGS. 10*a* and 10*b*, the fairlead 1 is configured such that its frame 60 is coupled to a pivot pin 300, and the pivot pin 300 extends down from upper and lower foundation brackets 50, 52, which are coupled to the hull structure 4. Thus, unlike the fairlead 1 depicted in FIGS. 1-4, the fairlead 1 depicted in FIGS. 10*a* and 10*b* is pivotally mounted below the hull points of connection (i.e., foundation brackets 50, 52).

OPERATION

During initial installation of the mooring chain 5, the chain latch assembly 90 with its latch head 192 may be held in the released position (as shown in FIG. 2*c*) by a tag line 110 connected to a small winch on the vessel deck. A messenger line is used to feed the chain 5 up from the anchor 6, through the chain sheave 70, and to the tensioning device (e.g., hauling equipment 7). The tensioning device 7 is then used to increase the tension in the chain 5. This operation varies somewhat depending on the vessel and its owner's requirements.

Once tension begins increasing in the chain 5, the tagline 110 is relaxed and the counterweights 197 cause the chain latch assembly 90 to pivot into the ratchet position shown in FIG. 2*b*. This causes the latch head 192 to come into contact with the chain 5 and to ride along (ratchet against) the links of the chain 5 as the chain 5 is in-hauled. As illustrated in FIGS. 5*a*-6*c*, when the chain 5 is in-hauled, the shape of the latches 193 causes the chain links to ride up and over the latches 193 without engaging. As can be seen in FIG. 2*b*, when the chain 5 is being in-hauled, the chain's line of action is essentially tangential to the circumference of the chain sheave 70.

Once the proper chain tension is reached, the tensioning device 7 begins paying out the chain 5. As the chain 5 is paid out, the engaging hook, latch or latch 193 of latch head 192 engages the nearest chain link that is parallel to the link platforms 152, 153 shown in FIGS. 5*a*-5*c*. The engagement between the chain 5 and the latch head 192 is brought about by the shape of the latches 193 and the bias force urging the latch head 192 against the chain 5. Engagement prevents further chain payout. The in-haul forces from the tensioning device 7 may be released, so that the chain tension is then transferred from the chain sheave 70 to the tension link 194 and into the horizontal sheave axle 80. As the tensioning device 7 continues to payout, the tension in the chain 5 causes the chain latch assembly 90 to pivot until its tension link 194 is in line with, and part of, a line of action running from the anchor 6, through the chain 5 and tension link 194, and into the horizontal sheave axle 80 supported by the fairlead frame 60 (see position assumed by the chain latch assembly 90 in FIG. 2*a*). Thus, the anchor chain's line of action has shifted from being essentially tangential to the circumference of the chain sheave 70 during the in-haul process (see FIG. 2*b*) to being essentially in-line with the axis of the axle 80 when the latch head 192 has fully engaged the chain 5 and the chain's tension load has been assumed by the tension link 194 (see FIG. 2*a*).

If it is desired to release the chain 5, the hauling equipment 7 on the deck must be engaged to in-haul the chain 5. Once the tension in the chain 5 is largely transferred from the tension link 194 to the chain sheave 70, the tag line 110 can pull on the counterweights 197 to pivot the chain latch assembly 90 from the engagement position (FIG. 2*a*) to the released position (FIG. 2*c*), thereby causing the latch head 192 to move away from chain 5. The chain can then be paid out without the latch head 192 engaging the chain 5.

Although the present invention has been described with reference to preferred embodiments, persons skilled in the art will recognize that changes may be made in form and detail without departing from the spirit and scope of the invention.

I claim:

1. A method for guiding and securing an anchor chain extending from a fairlead mounted on an offshore structure to an anchor, the method comprising:

providing a sheave rotatably mounted on a sheave axle supported by a fairlead frame pivotably coupled to the offshore structure;

providing a chain latch supported on the sheave axle, said chain latch having on one end a latch head for engaging the anchor chain and another end connected to pivot on the sheave axle;

in-hauling the anchor chain about the sheave so the anchor chain wraps on a portion of the circumference of the sheave and the tension force in the anchor chain below the sheave and connected to the anchor is applied through the sheave to the sheave axle; and pivoting the chain latch about the sheave axle to cause the latch head to engage the anchor chain, whereby the tension force in the anchor chain below the sheave and connected to the anchor is applied through the chain latch to the sheave axle.

2. The method of claim 1, wherein the step of pivoting the chain latch to engage the anchor chain further comprises biasing the chain latch to ride against the anchor chain.

3. The method of claim 2, further comprising paying out the anchor chain when the chain latch is biased to ride against the anchor chain until the latch head engages the anchor chain and the chain latch carries the tension force in the anchor chain.

4. A fairlead for guiding and securing a chain used for mooring an offshore structure, the fairlead comprising:

a fairlead frame pivotally mounted to the offshore structure;

a first structure coupled to the fairlead frame and adapted to cause the chain, when the chain is being paid out or in-hauled, to bend about a radius having a center point, whereby a force vector of the chain is applied to the radius; and a second structure connected to freely pivot at the center point, said pivot motion about the center point causing a latch head of the second structure to engage the chain and hold the chain, releasing the chain from bending about the radius and transmitting the line of action of the chain below the first structure through the second structure to the center point, wherein the second structure pivots to become substantially aligned with the chain immediately below the first structure.

5. The fairlead of claim 4, further comprising an apparatus adapted to bias the second structure to ride against the chain for engaging it.

6. The fairlead of claim 5, wherein the bias causes the latch head of the second structure to catch the chain when the chain is being paid out.

7. The fairlead of claim 4, wherein the second structure comprises a tension link pivotable about the center point.

8. The fairlead of claim 7, further comprising means for selectively pivoting the second means to bring the latch head into engagement with the chain when the chain is being paid out.

9. A fairlead for guiding and securing a chain used for mooring an offshore structure, the fairlead comprising:

a fairlead frame pivotally mounted to the offshore structure;

first means for causing the chain, when the chain is being paid out or in-hauled, to bend about a radius having a center point, wherein said first means is coupled to the fairlead frame; and second means for holding the chain, to release it from the first means and for transmitting through the second means to the center point the tension force in the chain below the first means, wherein the second means pivots on the center point to ride against the chain and to cause a latch head of the second means to engage the chain immediately below the first means so that the second means carries the tension force from the chain to the center point.

10. The fairlead of claim 9, further comprising means for selectively biasing the second means against the chain.

11. The fairlead of claim 10, wherein the means for selectively biasing cause the latch head to engage the chain when the chain is being paid out.

12. The fairlead of claim 9, wherein the first means is a wildcat mounted for rotation on an axle supported by the fairlead frame, the axle being centered on the center point.

13. The fairlead of claim 12, wherein the second means is pivotally mounted on the axle.

14. A method for guiding and securing an anchor chain at a fairlead mounted to an offshore structure, said anchor chain leading to an anchor, the method comprising:

providing a sheave rotatably mounted on a sheave axle supported by a fairlead frame pivotably coupled to the offshore structure;

providing a chain latch supported for pivoting on the sheave axle;

in-hauling the anchor chain about the sheave so the anchor chain wraps on a portion of the circumference of the sheave and tension force in the anchor chain below the sheave and connected to the anchor is applied through the sheave to the sheave axle; and pivoting the chain latch about the sheave axle to engage the anchor chain with a chain latch head by biasing the chain latch pivotally against the anchor chain, whereby the tension force in the anchor chain below the sheave and connected to the anchor is applied through the chain latch to the sheave axle.

15. The method of claim 14, further comprising paying out the anchor chain when the chain latch is biased against the anchor chain until the chain latch engages and carries the tension force in the anchor chain.

16. The method of claim 14, wherein the step of pivoting the chain latch to engage the anchor chain with a chain latch head further comprises keeping the tension force in the anchor chain below the sheave and connected to the anchor applied to the sheave axle upon transferring the tension force from the sheave to the chain latch.

17. The method of claim 16, wherein the chain tension force is transferred into the sheave axle by placing a portion of the chain latch in tension.

18. The method of claim 14, wherein the step of pivoting the chain latch to engage the anchor chain comprises selectively catching the chain with the chain latch head when the chain is being paid out.

* * * * *